United States Patent [19]

Portnoff

[11] Patent Number: 4,475,914

[45] Date of Patent: Oct. 9, 1984

[54] MEDICAMENT CONTAINER AND TRANSFER DEVICE

[75] Inventor: Joel B. Portnoff, Richboro, Pa.

[73] Assignee: Merck & Co., Inc., Rahway, N.J.

[21] Appl. No.: 412,749

[22] Filed: Aug. 30, 1982

[51] Int. Cl.[3] ..... A61J 1/08; B67B 7/24

[52] U.S. Cl. ..... 604/414; 141/309; 141/3; 222/83

[58] Field of Search ..... 604/411–414, 604/56, 88, 92, 201, 205; 141/329, 330, 309; 222/81–83

[56] References Cited

U.S. PATENT DOCUMENTS

| | | | |
|---|---|---|---|
| 2,953,132 | 9/1960 | Richter et al. | 604/414 |
| 3,938,520 | 2/1976 | Scislowicz et al. | 604/414 X |
| 4,191,225 | 3/1980 | Ogle | 604/414 X |
| 4,296,786 | 10/1981 | Brignola | 141/329 X |
| 4,303,069 | 12/1981 | Cohen | 604/201 |

OTHER PUBLICATIONS

"Remington's Pharmaceutical Sciences", 16th Edition, Arthur Osol, Editor & Chairman Editorial Bd., (1980), Mack Publishing Co., title pp. & pp. 1490–1494.

*Primary Examiner*—Dalton L. Truluck

*Attorney, Agent, or Firm*—Thomas E. Arther; Mario A. Monaco

[57] ABSTRACT

The application discloses a combination medicament container and transfer device connected with a bellows type sleeve. The transfer device is a double ended spike having internal conduits optionally vented through a sterile hydropholic allowing two way transfer of liquid from an intravenous solution container and a medicament container of relatively insoluble medicament.

1 Claim, 3 Drawing Figures

MEDICAMENT CONTAINER AND TRANSFER DEVICE

BACKGROUND OF THE INVENTION

The invention relates generally to containers for medicaments intended for intravenous administration.

Heretofore materials intended for intravenous solution are usually supplied as solutions or readily soluble solids contained in small glass vials sealed from contact with the atmosphere by a puncturable, flexible closure. This material is usually a freeze-dried solid or sterile powder and the container is sometimes under a partial vacuum. In order to prepare the soluble solid for intravenous administration, the medical personnel usually injects a small amount of sterile aqueous vehicle into the vial by use of a hypodermic syringe to dissolve the soluble solid. The concentrated solution is then diluted for intravenous administration by withdrawing the concentrated solution using a hypodermic syringe and injecting said solution into a flexible plastic bag or glass bottle containing a relatively large amount of an intravenous solution such as phvsiological saline or glucose.

A problem is presented when the solid to be administered has relatively low solubility in aqueous solution. In this case several transfers of solution into and out of the small vial to completely dissolve the solid in the relatively large volume of solution in the intraveuous bottle or bag. Multiple transfers to and from such containers are tedious and allows greater opportunity for contamination.

SUMMARY OF THE INVENTION

The present invention relates to a package for storage of relatively insoluble medicaments fitted with a transfer spike for relatively facile dispersion and transfer of the resulting slurry into an intravenous bottle or bag to form a clear solution for conventional intraveous drip administration. The medicament container is a relatively small vial equipped with a flexible puncturable closure integrally attached by means of a flexible bellows type sleeve to a double ended transfer spike, preferably vented through a sterile hydrophobic filter, which can be connected directly to the puncturable closure of an intravenous solution bag or bottle. The end of the spike not enclosed by a bellows type sleeve is protected from contact with the atmosphere by a removable flexible cap of the same shape as the tip of the transfer spike.

The principal object of the present invention is to provide a small sterile medicament container for storing a relatively insoluble medicament, said container being provided with a transfer spike, (a double ended hollow plastic device), through which intravenous solution can be admitted to dissolve the solid and expelled into an intravenous solution bottle or bag and the process repeated until the medicament is completely transferred into the intravenous bottle or bag.

Another object is to provide a small inexpensive disposable medicament container provided with a double ended transfer spike flexibly attached to said container.

A further object is to provide connecting means between said container and spike to facilitate 2-way flow of intravenous solution between an intravenous solution container and said container, to prevent contamination or accidental injection of a slurry if withdrawn via syringe, and to guarantee complete, rapid dissolution of the solid.

Other objects of the invention as well as the advantages and novel features thereof will become apparent from a perusal of the following description read in conjuction with the accompanying drawings in which.

Figure 1:
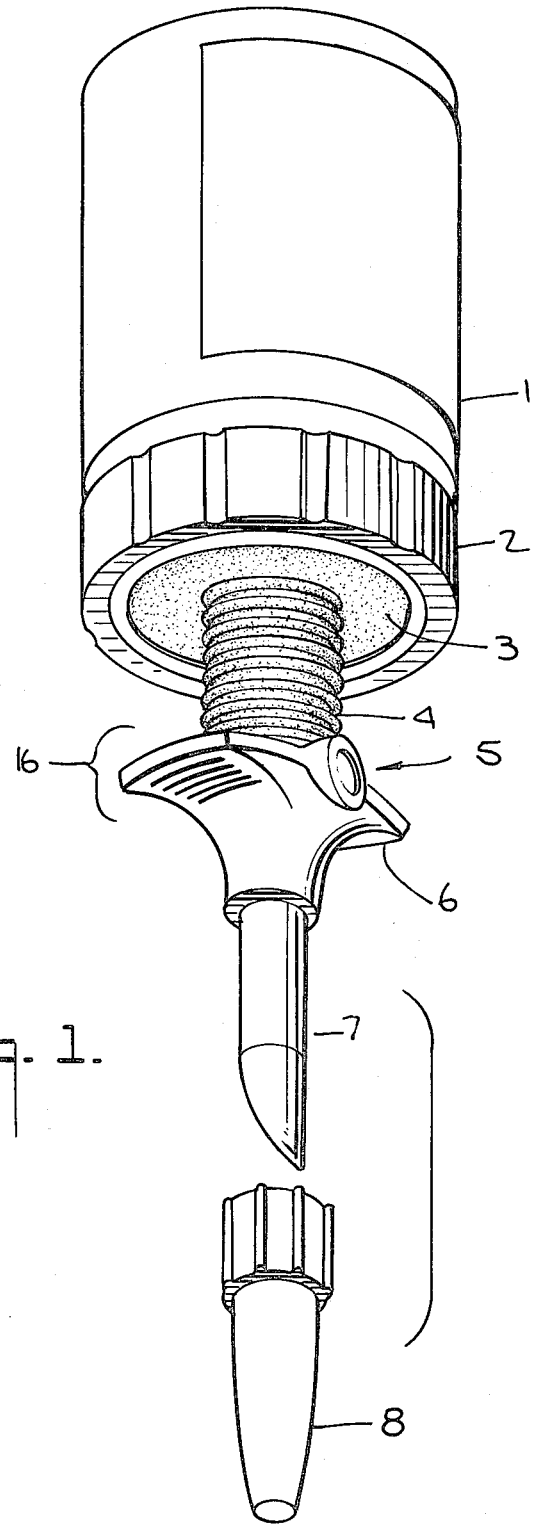
FIG. 1 is a perspective view of a preferred embodiment of applicants' invention showing the external appearance of the complete device.

As shown in FIG. 1, a double ended transfer spike (16) is attached at one end through a flexible bellows (4) to the neck of a medicament container (1) having the open end closed by a puncturable flexible rubber dam (3) integrally attached to one end of said bellows (4) and held in place by a metal or plastic collar (2) said transfer spike being provided with a horizontally extending flange type finger grip (6) located intermediately between the delivery end spike (7) and the puncturable flexible dam, said transfer spike being also fitted with an air vent protected by a hydrophobic sterile bacteria retentive filter (5), the delivery end spike (7) being protected from contaminants with a fitted spike cover (8).

Figure 2:
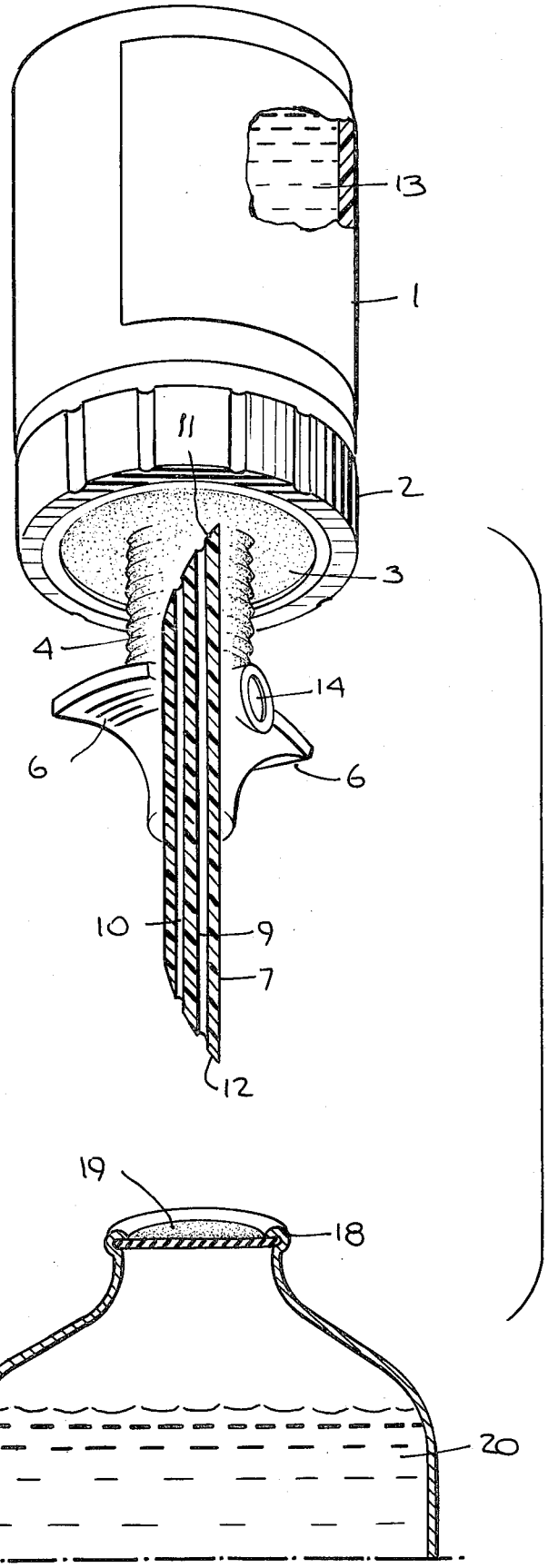
FIG. 2 is a partial vertical section view having the internal structure of the liquid transfer mechanism exposed, showing the medicament container connected by means of a bellows type sleeve to one end of a double ended transfer spike suitable for use with flexible intravenous bags.

As shown in FIG. 2, the delivery end spike (12) is exposed to permit puncture of the flexible puncturable entry port closure (19) of an intravenous solution bag. After puncture of the entry port of the intravenous solution container with the delivery end spikes, the medicament container end spike (11) in forced through the flexible dam (3) allowing access through conduits 9 and 10 through entry port 18 of intravenous solution container (17) and medicament container (1). The device is then inverted allowing solution to flow from flexible intravenous container (18) into medicament container (1) allowing a portion of slightly soluble medicament to dissolve. The position of the medicament container (1) and the solution container (17) is again reversed allowing dissolved solid medicament to flow into the intraveous solution container. In the case of a flexible intravenous container, such as an intravenous solution plastic bag, there in no need to vent the containers to the atmosphere to permit transfer of fluid from one container to the other. The process is repeated until the solid is completely dissolved and transferred into the larger volume intravenous solution container (17) and the medicament container (1) disconnected by withdrawing delivery end spike (12) from the intravenous solution container (17). The intravenous solution of medicament is now ready for intravenous administration through a conventional transfer spike.

Figure 3:
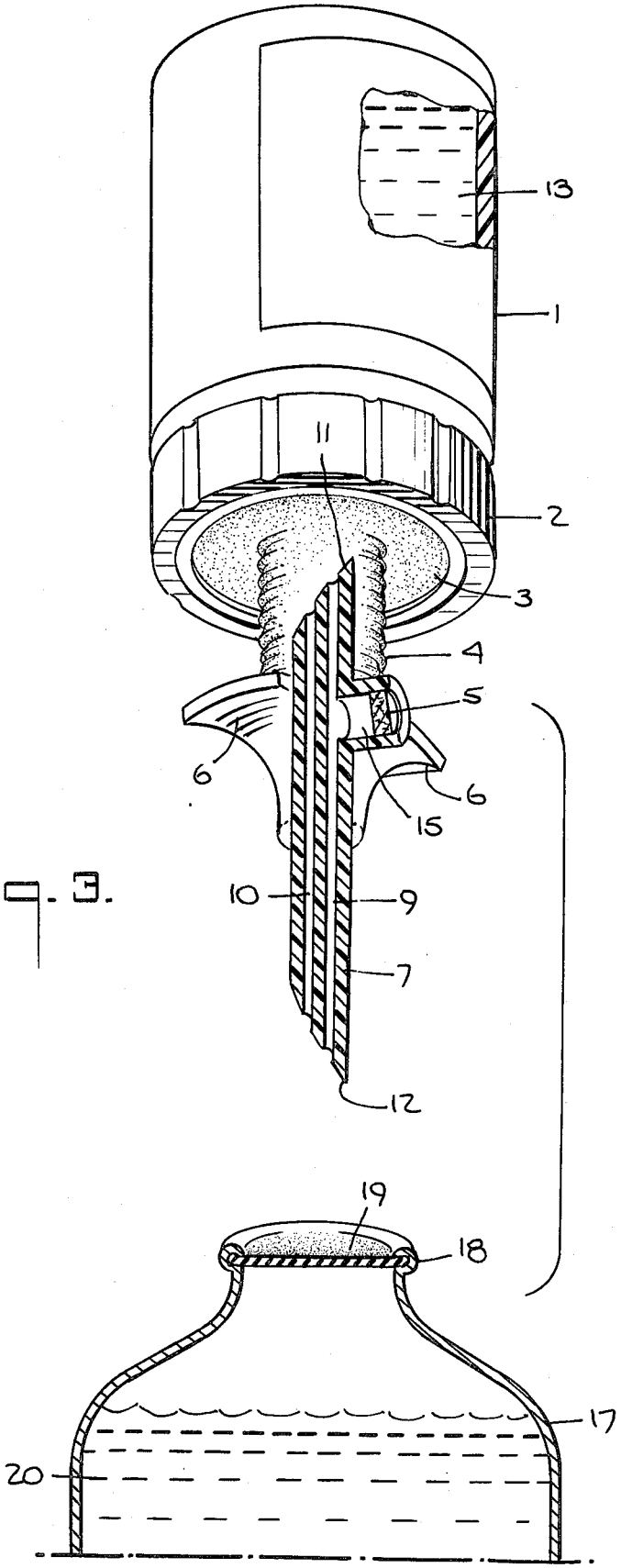
FIG. 3 is a partial vertical section view having the internal structure of the liquid transfer mechanism exposed showing the medicament container connected by means of a bellows type sleeve to one end of a double ended transfer spike suitable for use with an intravenous solution hottle.

As shown in FIG. 3 an optional configuration of the liquid transfer means is provided for use with an intravenous bottle (17). In this configuration, as shown in FIG. 3, there is provided an air vent tube (15) in communication with the medicament container (1) and intravenous solution bottle (17) by means of conduit (9) protected from contamination by means of a hydrophobic sterile bacteria retentive filter. The air vent is needed because of the rigid construction of the non-vented bottle compared to the easily deformable plastic bag. Using the same technique as described for FIG. 2, solution is readily transferred from one container to the other using the bellows type sleeve mechanism (4) to force air and liquid from one container to the other until the relatively insoluble medicament is completely dissolved and transferred to the intravenous solution bottle (17). The intravenous solution of medicament is now ready for intravenous administration through a conventional transfer spike.

What is claimed is:

1. In combination, a medicament container for relatively insoluble medicament and a transfer spike having one end enclosed in and connected with a bellows type sleeve to said medicament container, said container having its open end sealed from contact with the atmosphere by a flexible puncturable diaphragm integrally joined to said bellows sleeve, said transfer spike having at least two conduits extending longitudinally from end to end, one of said conduits being provided with a vent tube terminating in a sterile hydrophobic filter, and being provided with flange type finger grip means located intermediate the ends of said spike, the enclosed end of said spike being positioned within said bellows to allow puncture of said diaphragm with said enclosed end spike by compression of said bellows.

* * * * *